US005245952A

United States Patent [19]

Vasilakis

[11] Patent Number: 5,245,952

[45] Date of Patent: Sep. 21, 1993

[54] QUIET, NON-CONDENSING LIQUID HEATER USING A NON-MIXING BLOWER COMBUSTION SYSTEM

[75] Inventor: Andrew D. Vasilakis, Bedford, Mass.

[73] Assignee: Gas Research Institute, Chicago, Ill.

[21] Appl. No.: 728,161

[22] Filed: Jul. 10, 1991

[51] Int. Cl.[5] ..... F22B 9/02

[52] U.S. Cl. ..... 122/367.3; 122/367.1; 122/17; 110/328

[58] Field of Search ..... 122/367 R, 367 C, 33, 122/17; 126/350

[56] References Cited

U.S. PATENT DOCUMENTS

| | | | |
|---|---|---|---|
| 2,153,175 | 4/1939 | Duffy et al. | 110/328 |
| 2,533,104 | 12/1950 | Golden et al. | 110/328 |
| 3,101,774 | 8/1963 | Brevard | 110/328 |
| 3,269,449 | 8/1966 | Witten, Jr. | 110/328 |
| 3,701,340 | 10/1972 | Miller | 122/367.3 |
| 4,149,673 | 4/1979 | Hapgood | 122/367.1 |
| 4,222,350 | 9/1980 | Pompei et al. | 122/367.3 |
| 4,366,778 | 1/1983 | Charrier et al. | 122/367.3 |
| 4,502,626 | 3/1985 | Gerstmann et al. . | |
| 4,679,528 | 7/1987 | Krans et al. | 122/367.1 |

OTHER PUBLICATIONS

Sales brochure for Boston Gas Products, Inc., located at One Beacon St., Boston, Mass. 02108, Copyrighted in 1980. Diagram of Model BGP-103, Col. 2, paragraph 2 of the text.

*Primary Examiner*—Henry C. Yuen

*Attorney, Agent, or Firm*—Hamilton, Brook, Smith & Reynolds

[57] ABSTRACT

A fluid heater for a non-mixing blower combustion system comprises a flame holder including an igniter positioned at the region of highest gas-air concentration and an insert positioned in the lower portion of the flame holder to create a gas-air distribution along the length of the flame holder favorable to reliable ignition. The gas is ignited without creating an audible sound by assuring early ignition of the greatest concentration of the air fuel mixture. Also, the temperature of the exhaust gas from the heater is sufficiently high to prevent corrosive condensates from forming in the exhaust pipes. To prevent flashbacks in the air supply line, which could destroy the blower and associated duct work, the gas pressure is constantly monitored. If air flow does not occur, the gas supply line valve is closed to avoid flow of unburned gas outside the combustion chamber.

12 Claims, 3 Drawing Sheets

QUIET, NON-CONDENSING LIQUID HEATER USING A NON-MIXING BLOWER COMBUSTION SYSTEM

BACKGROUND OF THE INVENTION

Gas heaters are used in many homes to supply space heating and water heating. To improve efficiency, some burners mix gas and air together by a blower which is positioned between the gas and air supply lines. Since such a blower is constantly filled with combustible material, it emits gas odors and can be damaged if the gas ignites accidently. Thorough mixing of air and gas may not occur in compact heating systems which use short pipes. Also, high efficiency heat exchangers used in many burners produces exhaust condensates. Thus, relatively expensive exhaust pipes are needed to remove exhaust gases containing corrosive condensates from the heater.

SUMMARY OF THE INVENTION

By using a non-mixing blower, gas is removed from the blower region and the risk of an explosion is reduced. The air transmitted by the non-mixing blower can be used to entrain gas into the burner. Thus, the blower can be placed away from the burner and the risk of explosion further reduced. A system with a non-mixing blower, i.e. one which is not positioned between the burner and the gas and air supply lines, will not completely mix the gas with the air. As a result, such systems may be prone to poor ignition of the burner due to the maldistribution of the gas-air mixture. In a system with extremely short pipes and a non-mixing blower, ignition in the flame holder can be very unreliable. To avoid this problem, the gas heater of the invention is modified by shifting the position of the igniter to be directly below the gas and air inlet pipe at the region of maximum gas-air concentration. Moreover, a screen insert is placed in the flame holder to produce a less uniform vertical distribution of gas. Thus, a more favorable gas-air flow is produced near the igniter so that a quiet and reliable ignition of the gas and air is produced. By shifting the position of the igniter and making the gas distribution less uniform, a small volume of gas can be ignited quickly, before an explosive volume of gas can build up in the burner.

To eliminate corrosive condensates in the exhaust system, the efficiency of the fluid heater is reduced in order to increase the exhaust gas temperature. Thus, acidic sulfur condensates are eliminated. The fluid heater efficiency is reduced by using a helical concentric coil of tubing to carry fluid to be heated. A single coil of tubing or pipe is arranged to permit gases to pass between the turns of the tubing or pipe. The helical tubing is positioned coaxially with the flame holder and the concentric tubes are separated to permit the passage of combustion products to reduce the efficiency of the fluid heater. Thus, the temperature of the exhaust combustion products remains elevated and prevents the creation of condensates.

To avoid flashbacks, the gas supply is fed through a valve to the pipe carrying the air supply. This gas valve monitors the air pressure in the air supply line (between the gas inlet and the blower), as well as the gas pressure at the gas inlet pipe. When the gas pressure at the gas inlet is minus 0.4 inches of water pressure greater than the pressure at the air supply line, automatic cut-off of gas results. Thus, the hazardous accumulation of gas is prevented since if there is no air flow, there is no gas flow. Also, by positioning the blower away from the gas supply line, flashbacks are stopped and damage to the blower and associated duct work is prevented. Since gas is not concentrated in the non-mixing blower, flashbacks are less likely to occur.

A fluid heater according to the invention comprises an air-gas input system including an air-gas pipe, a blower, an air pipe coupling the blower to the air-gas pipe, a gas pipe coupled to the air-gas pipe so that air flowing in the air pipe draws gas in the gas pipe into the air-gas pipe, and a valve coupled to the gas pipe. The valve monitors the respective pressures in the gas pipe and the air pipe so that gas flow is blocked and flashback is prevented when there is no air flow. The gas heater assembly includes a flame holder, with a screen insert positioned in a lower segment of said flame holder, to effect a higher gas-air flow near the igniter. The igniter is positioned adjacent the flame holder, beneath the air-gas pipe, in this region of increased gas-air flow, to ignite the mixture without creating an audible sound by igniting the mixture instantly. A helical fluid pipe is positioned coaxially with the flame holder for heating fluid at a lower efficiency to prevent condensation from the burning of gas and resulting corrosion in the exhaust pipes.

Thus, the problem of gas heater ignition in the context of a non-mixing blower and short air and gas supply pipes with elbows is solved. Although gas and air may not be thoroughly mixed in the pipes, ignition is consistent. The insert in the flame holder used in conjunction with an igniter placed beneath the air-gas input pipe in the region of maximum gas distribution provides quiet, consistent and uniform ignition of the gas burner. Moreover, the use of a low efficiency heat exchanger to prevent the formation of condensates and a gas cut-off valve to prevent flashback create an inexpensive, safe, low maintenance, hydronic heater which provides space and water heating for a multi-family unit or small home. Because of its small size, it can be easily integrated with an air conditioning system to provide all three functions in a single system.

The above and other features of the invention including various novel details o construction in combination or in part will now be more particularly described with reference to the accompanying drawings and pointed out in the claims. It will be understood that the particular device embodying the invention is shown by way of illustration only and not as a limitation of the invention. The principles and features of this invention will be employed and varied in numerous embodiments without departing from the scope of the invention.

BRIEF DESCRIPTION OF THE DRAWINGS

FIG. 4(*b*) shows a top view of the gas heater which illustrates the position of the igniter.

DETAILED DESCRIPTION OF THE INVENTION

Figure 1:
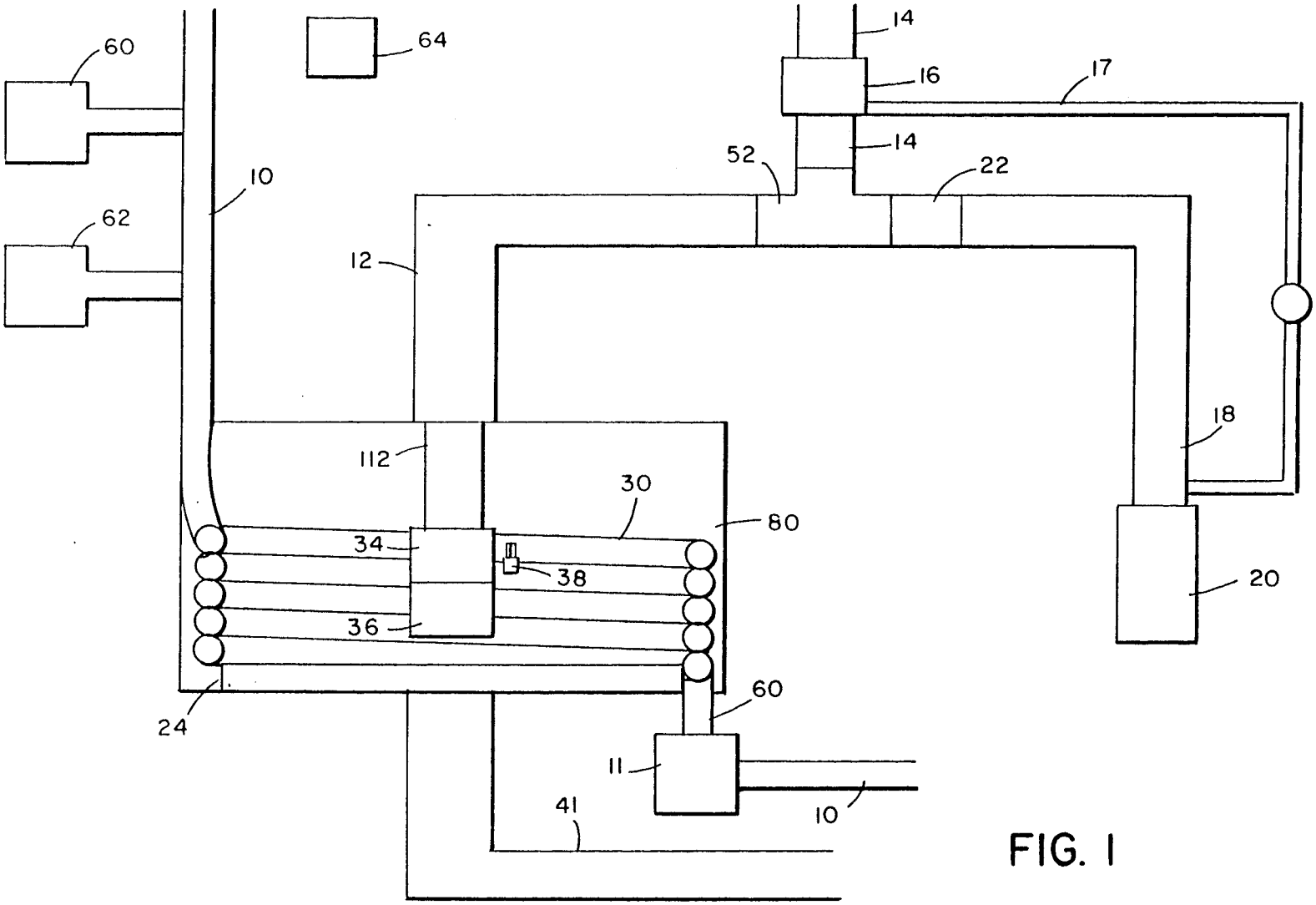
FIG. 1 is a schematic representation of the fluid heater of the invention.

FIG. 1 illustrates schematically the fluid heater of the invention. Non-mixing blower 20 supplies only air to air pipe 18. Tee 52 couples air pipe 18 to the air and gas inlet pipe 12. Gas pipe 14 is coupled to the air and gas inlet pipe 12 at tee 52. Air flowing from air pipe 18 across orifice 22 causes gas to flow into pipe 12. By placing non-mixing blower 20 and portions of pipe 18 downstream and away from gas pipe 14, the blower 20 and adjacent pipes are less likely to be damaged by a flashback.

Gas valve 16 monitors the pressure in air pipe 18 and gas pipe 14. If the pressure in air-gas pipe 12 minus 0.4 inches of water is greater than the air pressure in air pipe 18, valve 16 will close and gas will stop flowing through gas pipe 14. Thus, valve 16 serves as a safety feature. Flashback, which would destroy the blower and associated duct work, is prevented.

Air-gas pipe 12 is connected to boiler or heater 80 and supplies a combustible mixture to flame holder 34. The heat generated by the flame warms the fluid in the heat exchanging coil of tubing or piping 30. Typically, cold water enters the heater through pipe 60 which is coupled to piping 30. The heated water exits the heater from pipe 10 and can be supplied to a space heater 60 or a water heater 62. An air conditioner 64 can also be attached to the system. The water is returned to the heater 80 by recirculating pump 11. As will be explained in detail below, combustion products are removed from the burner by exhaust pipe 41.

To conserve space and materials, the gas pipes in the system are extremely short and have innumerable elbows. As noted previously, gas from pipe 14 is forced into pipe 12 by the flow of air across orifice 22. Pipe 12 makes a right angle elbow before entering burner 80. As a result, the mixture of air and gas is somewhat uneven in air-gas pipe 12, as well as around the flame holder 34 of the gas heater 80 as shown in FIG. 1. Large amounts of combustible material can gather in the burner and cause an audible "pop". To avoid this problem, Applicant has constructed a gas heater assembly comprising an input pipe 12, a flame holder 34, a fluid pipe 30, and an exhaust pipe 41 as illustrated in FIGS. 1, 3, 4*a* and 4*b*.

Figure 4B:
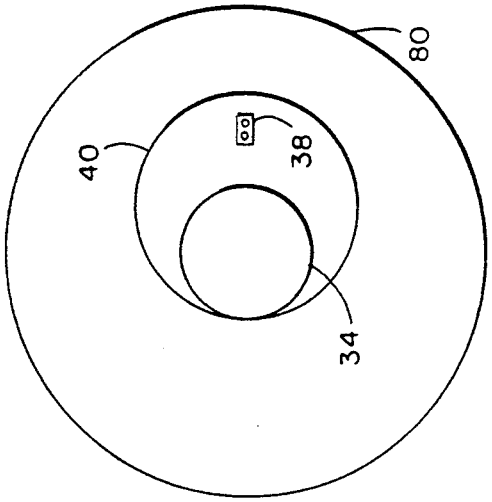
FIG. 4(*a*) shows a side view of the gas heater which illustrates the position of the igniter relative to the air and gas inlet pipe.
Figure 4A:
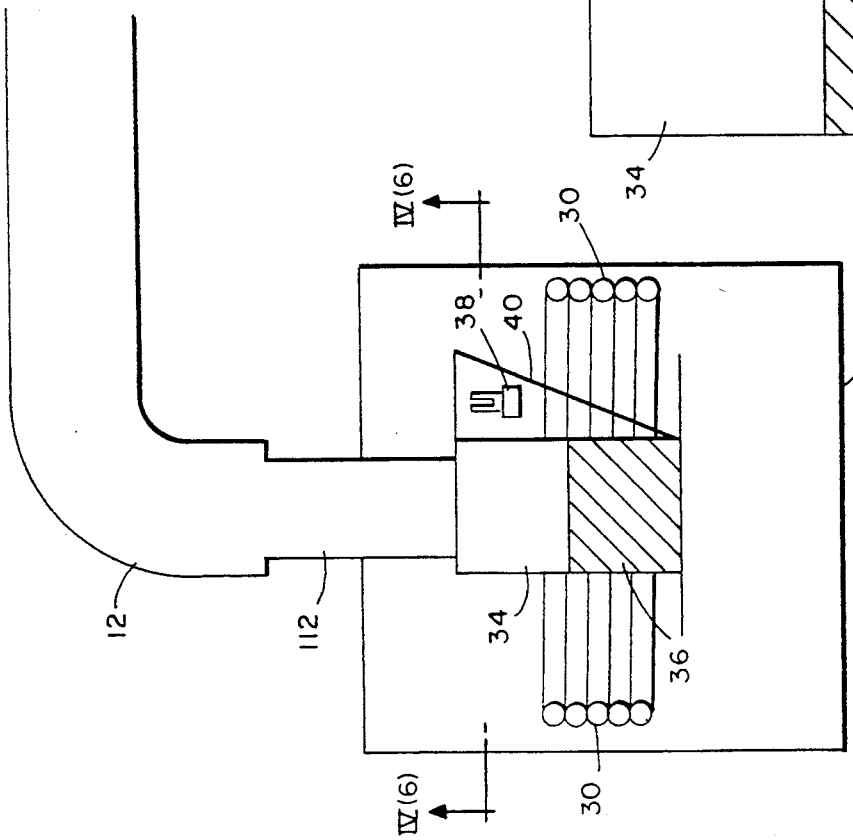

Since the air and gas streams are not well mixed in conventional systems, special geometric constraints in arranging such a system must be overcome. A specific relationship has been developed between the igniter 38, the gas and air pipe 12, and their relationship to the flame holder 34. After careful study of test burners by the Applicant, two conclusions are reached. FIGS. 4*a* and 4*b* illustrate the first conclusion. Water pipe 30 is shown in cross section. The igniter 38 for the flame holder 34 should be positioned beneath the air and gas inlet pipe 12 elbow. Because of the vortices created by the curves and elbows in pipe 12, maldistribution occurs in flameholder 34. By placing igniter 38 beneath the air-gas pipe 12, early ignition of the heater can be achieved. This is illustrated by the position of the gas distribution envelope 40 which shows igniter 38 at its apex.

Figure 3:
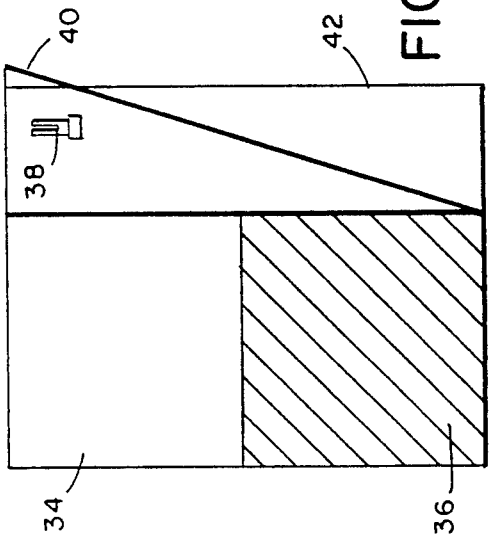
FIG. 3 illustrates a flame holder with a screen insert to create a favorable gas-air distribution.

A second conclusion is that the air-fuel distribution along the length of flame holder was uniform. While this might seen intuitively desirable, this did not provide sufficient air fuel at the igniter position for reliable and consistent ignition. This deficiency is overcome by inserting a piece of screening 36 with a 30% open area into the flame holder 34. FIGS. 3 and 4*a* illustrate the flame holder 34 with the screen insert 36. Flame holder 34 is a hollow, cylindrical, elongated, perforated shell coupled to the air and gas inlet pipe 12. An interface input pipe 112 couples air and gas pipe 12 to the flame holder 34. With screen insert 36 placed at the bottom of flame holder 34, a favorable distribution of the gas at the top of the flame holder is achieved. Envelope 42 illustrates the gas distribution in the burner without the insert 36. Large amounts of gas-air accumulate in the burner before ignition occurs when insert 36 is not used. As a result, a loud "pop" is produced when the mixture ignites. By comparison, the gas distributor 40, which occurs when insert 36 is present, results in an early, quiet, efficient ignition.

Figure 2:
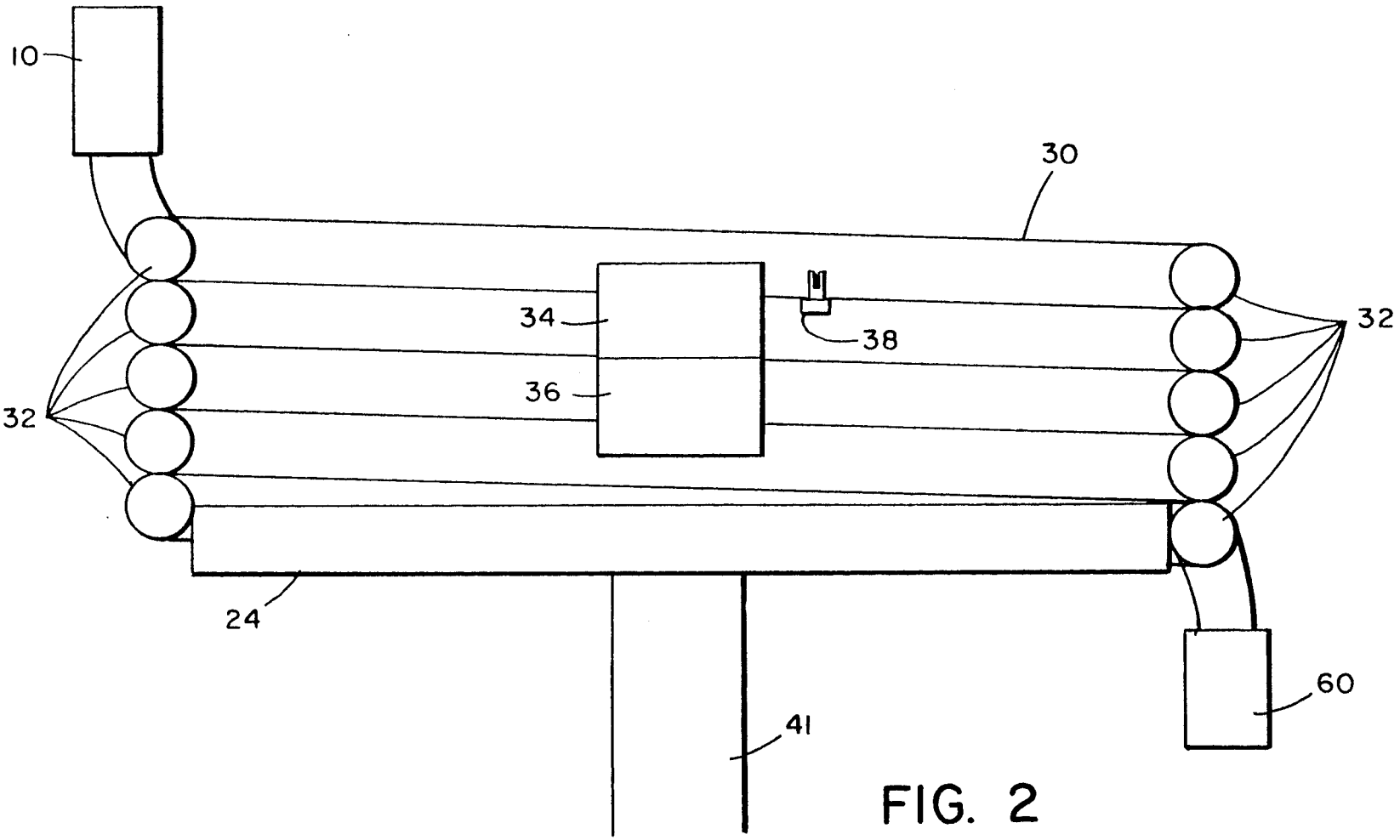
FIG. 2 shows a gas heater coil assembly with reduced efficiency to prevent condensation of combustion products.

One problem associated with the use of high efficiency systems with common combustion exhaust gas venting equipment is the formation of condensates in the exhaust system 41 which can corrode the pipes. To eliminate this problem, a boiler construction with a lower efficiency is chosen. FIG. 2 illustrates the interior construction of lower efficiency gas heater-fluid heater 30 which eliminates exhaust condensates form exhaust pipe 41. Helical water pipe 30 is positioned coaxially with flame holder 34. Cold fluid enters pipe 30 at opening 60 and exits as hot fluid at opening 10. Bottom pan 24 holds a layer of refractory material 25 which insulates the lower section of the combustion chamber. Coil 30 is comprised of integral low finned tubing (annealed), 19 fins per inch, supplied by Southwest Alloy Supply Co. The tube has an outer diameter of 0.75 inches and is arranged in four and one half coaxial rings with a total height of 3 inches. The helix has an inner diameter of 8 inches and an outer diameter of 9.5 inches. Interfaces 32 between the concentric pipes 30 of the water system of the gas burner coil assembly are arranged so as to decrease the efficiency of the system. With baffles positioned at interfaces 32, the system achieves a 87 to 88% efficiently rating. However, with the baffles removed as shown in FIG. 2, the efficiency is reduced to 82%. At this lower efficiency level, the exhaust gas temperature is high enough to prevent condensation of acidic fluids in the exhaust pipe 41. While this can be done with temperature control valves that keep the fluid temperature sufficiently high to avoid the dewpoint of the combustion gases, such temperature control valves are expensive. An easier way of achieving the same result is effected in the invention by selecting pressure drops, coil spacing, and gas flow rates that would avoid this temperature region for a specific firing rate and air-to-fluid coil arrangement. It has been found that a firing rate of 50,000 BTUs per hour with a flow rate of 3 gallons per minute (GPM) in the gas burner in combination with an appropriately sized, parallel pass liquid-to-gas heat exchanging coil will achieve this non-condensate status. For example, concentric coils 30 are slightly separated to allow combustion products to flow through interfaces 32 and lower the efficiency of the gas burner. In summary, by using a short, single coil of tubing with separated turns as a heat exchange coil, the burner efficiency is lowered and the temperature of combustion products exiting through exhaust pipe 41 is high enough to prevent condensation of corrosive by-products. Thus, the exhaust pipe 41 can be constructed of inexpensive materials.

Thus, the Applicant's invention eliminates ignition pop in a natural gas or propane fired hydronic heater. By changing the position of the igniter and adding a flame holder insert, a less uniform vertical gas distribution produces a quiet ignition. Ignition efficiency is increased despite the lack of uniform mixing of gas and air in the short pipes and elbows of the supply system. Moreover, condensates which could cause corrosion of the piping are eliminated from the exhaust system. This is achieved by reducing the efficiency of the burner such that the exhaust temperature is high enough to prevent condensation. Finally, gas flashbacks are prevented by monitoring pressures in the respective air and gas pipes and closing a valve during loss of air. In the preferred embodiment, air conditioning, as well as space heating, features are combined in a single unit. Water heater elements can be positioned separate from the boiler. For example, FIG. 1 shows a space heating element 60 and a water heating element 62 connected to outlet 10 of water pipe 30. Also, as noted above, an air conditioning element 64 can be associated with the combustion system.

Persons who are skilled in the art will recognize or be able to ascertain using no more than route experimentation many equivalents to this specific embodiment of the invention described herein. These and all other equivalents are intended to be encompassed by these following claims:

I claim:

1. A fluid heater comprising:

a nonlinear air and gas inlet pipe (12);

a hollow, elongated, perforated flame holder (34) connected to the air and gas inlet pipe (12), air and gas passing through the flame holder before combustion and igniting into a flame about its outside surface;

an igniter (38), positioned adjacent the flame holder (34) beneath the air and gas inlet pipe (12), at the region of highest gas-air flow;

an insert (36), positioned in a lower portion of the flame holder, to retard gas-air flow through perforations in the lower portion of the flame holder and to produce a more favorable gas-air flow near the igniter so that a quiet and reliable ignition of the gas and air outside of the flame holder is produced; and a fluid heat exchanger carrying fluid to be heated by combustion of the air and gas.

2. A fluid heater, as recited in claim 1, further comprising an exhaust outlet pipe (410 coupled to the flame holder (34), wherein the efficiency of the heater produces an exhaust gas temperature which prevents the condensation of combustion products.

3. A fluid heater, as recited in claim 1, wherein said insert further comprises a screen.

4. A fluid heater, as recited in claim 1, wherein the more favorable gas-air flow is a non-uniform distribution along the length of the flame holder.

5. A fluid heater comprising:

a nonlinear air and gas inlet pipe (12);

a hollow, elongated, perforated flame holder (34) beneath the air and gas inlet pipe (12), air and gas passing through the flame holder before combustion and igniting into a flame about its outside surface;

an igniter (38), positioned adjacent the flame holder (34) beneath the air and gas inlet pipe (12), at the region of highest gas concentration;

an insert (36), positioned in a lower portion of the flame holder, to retard gas-air flow through perforations in the lower portion of the flame holder and to produce a more favorable gas-air flow near the igniter so that a quiet and reliable ignition of the gas and air outside of the flame holder is produced;

an exhaust pipe (41) connected to the exhaust product of combustion from the flame holder (34); and a single helical coil of tubing (30) positioned coaxially with the flame holder (34), and carrying fluid to be heated, so that the exhaust pipe temperature is sufficiently high to prevent condensates from forming.

6. A fluid heater, as recited in claim 5, wherein the helical, concentric coils of tubing (30) are separated to permit the passage of combustion products so that the efficiency of the heater is less than 85%.

7. A fluid heater, as recited in claim 5, wherein the more favorable gas-air flow is a non-uniform distribution along the length of the flame holder.

8. A fluid heater comprising:

(a) an air-gas input system including:

(i) a short, nonlinear air-gas pipe (12) with a distal end and a proximal end;

(ii) a blower (20);

(iii) an air pipe (18) for supplying air coupling the blower (20) to the proximal end of the air-gas input pipe (12);

(iv) a gas pipe (14), for supplying gas, coupled to the proximal end of the air-gas pipe (12) wherein air flowing in air pipe (18) draws gas from gas pipe (14) into air-gas pipe (12); and (v) a valve (16), coupled to the gas pipe (14), said valve monitors the respective pressures in the gas pipe (14) and the air pipe (18) and blocks gas flow in the gas pipe (14) when there is no air flow in the air pipe to prevent flashback; and (b) a gas heater assembly including:

(i) an interface input pipe (112) connected to said air-gas pipe (12);

(ii) a hollow, cylindrical flame holder (34), coupled to said input pipe (112), including:

(a) a screen insert (36), positioned in a lower segment of said flame holder (34) to retard gas-air flow in the lower flame holder region to produce a more favorable gas-air flow; and (b) an igniter (38) positioned adjacent the flame holder (34) beneath the air-gas pipe (12) in a region of more favorable gas-air flow so that a quiet and reliable ignition of the gas and air is produced;

(iii) a single helical coil of fluid pipe (30) positioned coaxially with the flame holder (34) for heating fluid at an efficiency level which prevents condensates from the burning of gas; and (iv) an exhaust pipe (41), coupled to the flame holder (34) to remove combustion products from the burner.

9. A fluid heater, as recited in claim 11, wherein the more favorable gas-air flow is a non-uniform distribution along the length of the flame holder.

10. A fluid heater, as recited in claim 11, further comprising:

a space heater (60) and a water heater (62), coupled to said helical fluid pipe (30).

11. A fluid heater comprising:

a nonlinear air and gas inlet pipe (12);

a hollow, elongated, perforated flame holder (34) connected to the air and gas inlet pipe (12), air and gas passing through the flame holder before combustion and igniting into a flame about its outside surface;

an igniter (38), positioned adjacent the flame holder (34);

an insert (36), positioned in a portion of the flame holder, to retard gas-air flow through perforations in the portion of the flame holder to produce a more favorable gas-air flow near the igniter for ignition of the gas and air outside of the flame holder; and a fluid heat exchanger carrying fluid to be heated by combustion of the air and gas.

12. A fluid heater comprising:

a nonlinear air and gas inlet pipe (12);

a hollow, elongated, perforated flame holder (34) connected to the air and gas inlet pipe (12);

an igniter (38), positioned adjacent the flame holder (34);

an insert (36), positioned in a portion of the flame holder, to retard gas-air flow through perforations in the portion of the flame holder to produce a more favorable gas-air flow near the igniter for ignition of the gas and air outside of the flame holder;

an exhaust pipe (41) connected to the exhaust product of combustion from the flame holder (34); and a single helical coil of tubing (30) positioned coaxially with the flame holder (34), and carrying fluid to be heated, so that the exhaust pipe temperature is sufficiently high to prevent condensates from forming.

* * * * *

UNITED STATES PATENT AND TRADEMARK OFFICE

CERTIFICATE OF CORRECTION

PATENT NO. : 5,245,952
DATED : September 21, 1993
INVENTOR(S) : Andrew D. Vasilakis It is certified that error appears in the above-indentified patent and that said Letters Patent is hereby corrected as shown below:

Column 5, line 46, change "outlet pipe (410" to --outlet pipe (41--.
Column 6, line 55, change "11" to --8--.
Column 6, line 58, change "11" to --8--.

Signed and Sealed this
Fifth Day of April, 1994

Bruce Lehman

*Attest:*

BRUCE LEHMAN

*Attesting Officer*

*Commissioner of Patents and Trademarks*